United States Patent [19]

Silcox

[11] Patent Number: 4,625,806

[45] Date of Patent: Dec. 2, 1986

[54] SUBSEA DRILLING AND PRODUCTION SYSTEM FOR USE AT A MULTIWELL SITE

[75] Inventor: William H. Silcox, San Francisco, Calif.

[73] Assignee: Chevron Research Company, San Francisco, Calif.

[21] Appl. No.: 663,006

[22] Filed: Oct. 19, 1984

Related U.S. Application Data

[63] Continuation of Ser. No. 78,992, Sep. 26, 1979, abandoned, which is a continuation of Ser. No. 903,327, May 5, 1978, abandoned, which is a continuation-in-part of Ser. No. 754,391, Dec. 27, 1976, abandoned.

[51] Int. Cl.[4] ..... E21B 43/013; E21B 43/017; E21B 7/128

[52] U.S. Cl. ..... 166/358; 166/339; 166/347; 166/365; 166/366; 166/368; 175/7

[58] Field of Search ..... 175/5, 7; 166/339, 347, 166/334, 351, 353, 354, 355, 366, 365, 358, 75 R, 75 A; 405/169

[56] References Cited

U.S. PATENT DOCUMENTS

| | | | |
|---|---|---|---|
| 3,090,437 | 5/1963 | Geer | 166/340 X |
| 3,380,520 | 4/1968 | Pease | 166/366 X |
| 3,413,946 | 12/1968 | Schultz | 175/5 X |
| 3,536,135 | 10/1970 | Dozier | 166/347 |
| 3,586,103 | 6/1971 | Brown | 166/366 |
| 3,618,661 | 11/1971 | Peterman | 166/366 X |
| 3,633,667 | 1/1972 | Falkner, Jr. | 166/365 X |
| 3,703,207 | 11/1972 | Horton | 166/366 X |
| 3,760,875 | 9/1973 | Busking | 166/354 |
| 3,770,052 | 11/1973 | Childers | 166/351 |
| 3,777,812 | 12/1973 | Burkhardt | 166/338 |
| 3,788,396 | 1/1974 | Shatto, Jr. et al. | 175/5 X |
| 3,877,520 | 5/1975 | Putman | 166/366 |
| 3,987,638 | 10/1976 | Burkhardt et al. | 175/9 X |
| 4,031,544 | 6/1977 | Lapetina | 175/5 X |
| 4,090,560 | 5/1978 | Hoel | 405/169 X |
| 4,120,362 | 10/1978 | Chateau et al. | 166/339 |

*Primary Examiner*—James A. Leppink
*Assistant Examiner*—Hoang C. Dang
*Attorney, Agent, or Firm*—S. R. LaPaglia; E. J. Keeling; P. L. McGarrigle

[57] ABSTRACT

A subsea drilling and production system where the production unit is removably connected onto a drilling template and operatively connected to one or more Christmas trees so that the production unit may be disconnected from the trees and removed from the template without first removing any of the trees and so that any of the trees may be disconnected from the production unit and removed from the underwater site without removing the production unit.

20 Claims, 19 Drawing Figures

SUBSEA DRILLING AND PRODUCTION SYSTEM FOR USE AT A MULTIWELL SITE

CROSS-REFERENCE TO RELATED APPLICATIONS

This is a continuation of application Ser. No. 78,992, filed Sept. 26, 1979 now abandoned, which is a continuation of application Ser. No. 903,327, filed May 5, 1978 now abandoned, which in turn is a continuation-in-part of application Ser. No. 754,391, filed Dec. 27, 1976, now abandoned.

FIELD OF THE INVENTION

The present invention relates to subsea drilling and production operations, and more particularly, to a system for drilling, completing and producing oil and gas wells at a multi-well site.

BACKGROUND OF THE INVENTION

Much of today's search for new oil and gas supplies is being conducted offshore. Offshore operations, however, are usually more expensive than onshore operations and require a much larger commitment of capital with no greater guarantee that oil or gas will be found at any particular site. In a typical operation, an exploratory well is drilled from a floating vessel at a site where geological and geophysical data indicate the possibility of finding oil and/or gas in commercially producible amounts. If significant reserves are located, an offshore platform may be erected from which a number of wells may be drilled and completed. In conducting operations from the platform, the wellhead may be located above the surface of the water with the production and completion equipment available on the platform. In this case, the operation of the well is not greatly different from the operation of a well at an onshore site.

However, in very deep waters or where local conditions and expected returns make bottom-supported platforms uneconomical, it is desirable, if not necessary, to provide a subsea system for drilling, completing and producing wells. Although much effort has gone into the design of subsea drilling and production installations, the various designs proposed heretofore have been found to have certain shortcomings. In some subsea production installations, the necessary production equipment is made an integral part of the drilling template. Thus, production equipment is committed to the underwater site prior to verifying the actual extent of the field to be developed. In other subsea production installations, the equipment is arranged on the template in such a manner that maintenance and repair of the system is very costly and difficult. This results from the fact that certain production equipment cannot be removed from the template without first removing other associated equipment.

For instance, U.S. Pat. No. 3,618,661 discloses a subsea production installation having a multiwell drilling template, a manifold module releasably secured on the template, and a plurality of production wellhead assemblies or Christmas trees operatively connected on top of the manifold module. In this arrangement, the Christmas trees are connected on top of the manifold module such that the manifold module cannot be removed without first removing the Christmas trees. This, of course, is very inconvenient and costly should the manifold module have to be removed, to be repaired or replaced.

Another approach is disclosed in U.S. Pat. No. 3,778,812 in which the subsea production system includes a multiwell drilling template completely equipped with all the necessary manifold piping and equipment for handling well production fluids, gas injection, and well maintenance. In this system, the production wells are drilled through the fully-equipped template; thus, production equipment is committed to a particular site without first verifying the extent of the commercially producible reserves. Therefore, should the particular drilling site turn out to have fewer commercial wells than anticipated, an unnecessary and expensive investment in production equipment has been made.

From the above, it can be seen that there exists a need in the art for a subsea drilling and production system that is relatively inexpensive to maintain and that does not commit production equipment to a particular drilling site prior to verifying the actual extent of the reserves at the site.

SUMMARY OF THE INVENTION

Broadly speaking, the present invention is for a subsea system for drilling, completing and producing wells. This system limits production equipment committed to a particular site to that which is actually necessary in terms of the size of the field to be produced. This system also provides that production equipment be arranged on the template in a manner which reduces maintenance costs.

To accomplish the above, a drilling template is first positioned on the underwater bottom for the purpose of drilling a well or a number of wells. After the extent of the field is determined, an appropriate production unit is removably positioned on the template. Christmas trees are then lowered to the template and disconnectably connected to the casingheads at the various wells. Flowline and control-line means are provided to respectively connect the Christmas trees to the manifold piping and control lines of the production unit. The Christmas trees are connected to the production unit in a manner which permits the production unit to be disconnected from the Christmas trees so that it may be removed from the template without first having to remove any of the Christmas trees. Likewise, any of the Christmas trees may be disconnected from the production unit so that any tree may be removed from its casinghead without first removing the production unit or any other tree.

Moreover, in this drilling and producting system, the production unit may be actually comprised of a number of different sections connected into operative association with each other.

DESCRIPTION OF THE PREFERRED EMBODIMENT

Figure 1:
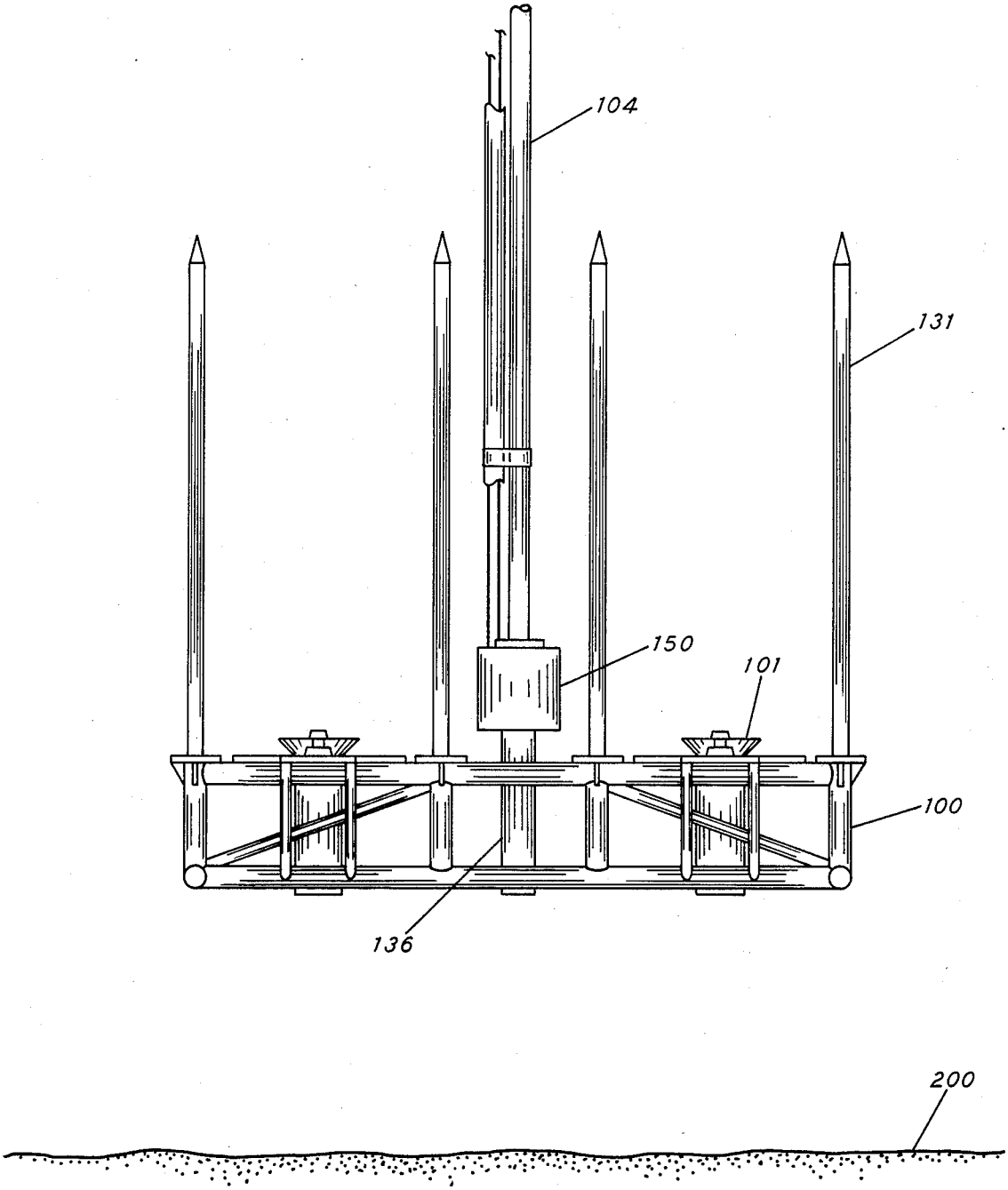
FIG. 1 is a schematic view illustrating a drilling template being lowered through the water to the subsea bottom.

Now referring to the drawings, FIG. 1 represents a drilling template or template frame 100 being lowered to subsea bottom 200. The template may be lowered by any appropriate means, and as is shown, it may be lowered on a drill string 104 which is connected to the template by a hydraulic connector 150.

Figure 2:
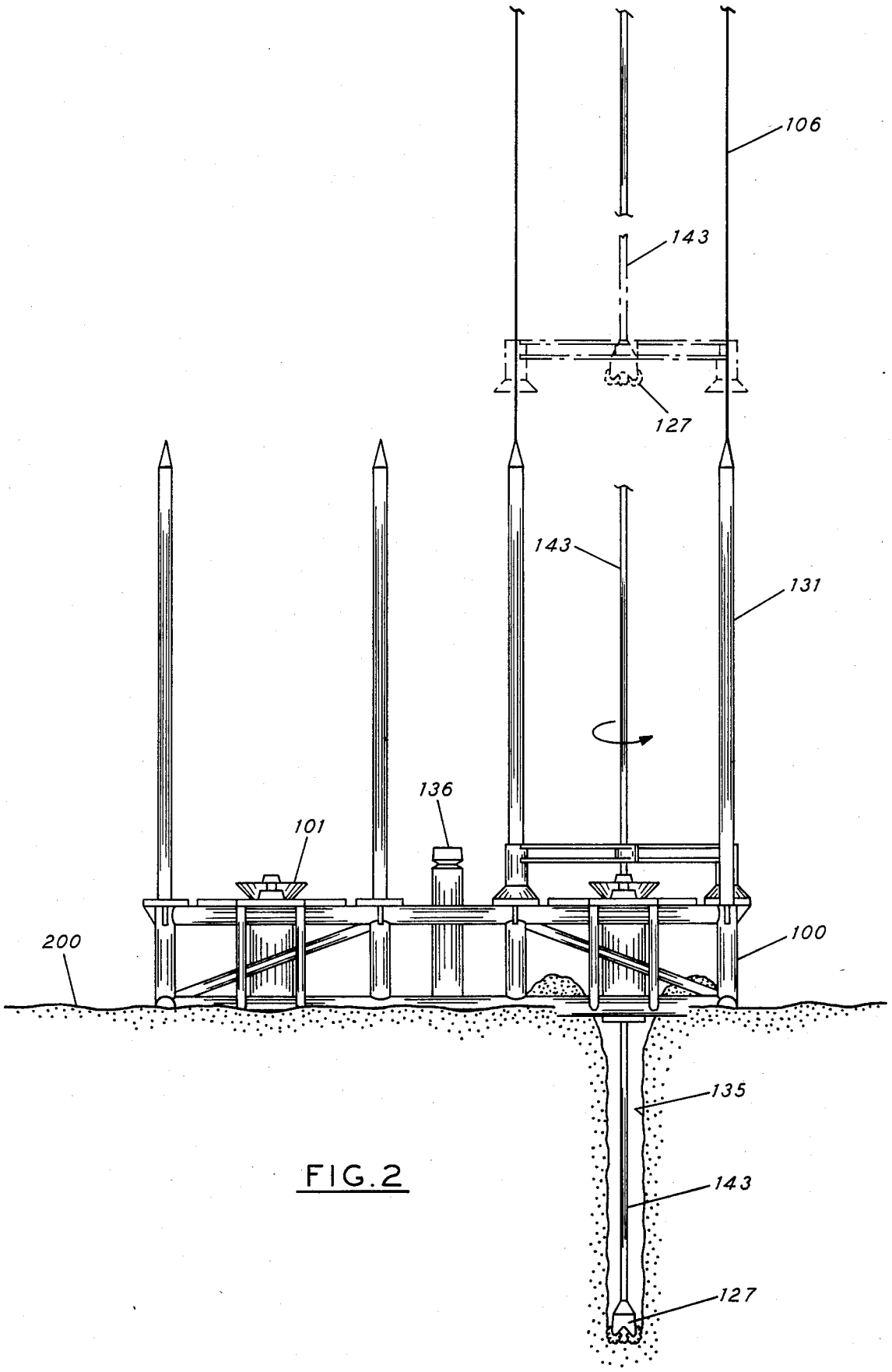
FIG. 2 shows the drilling template positioned on the subsea bottom with drilling operations taking place.
Figure 13:
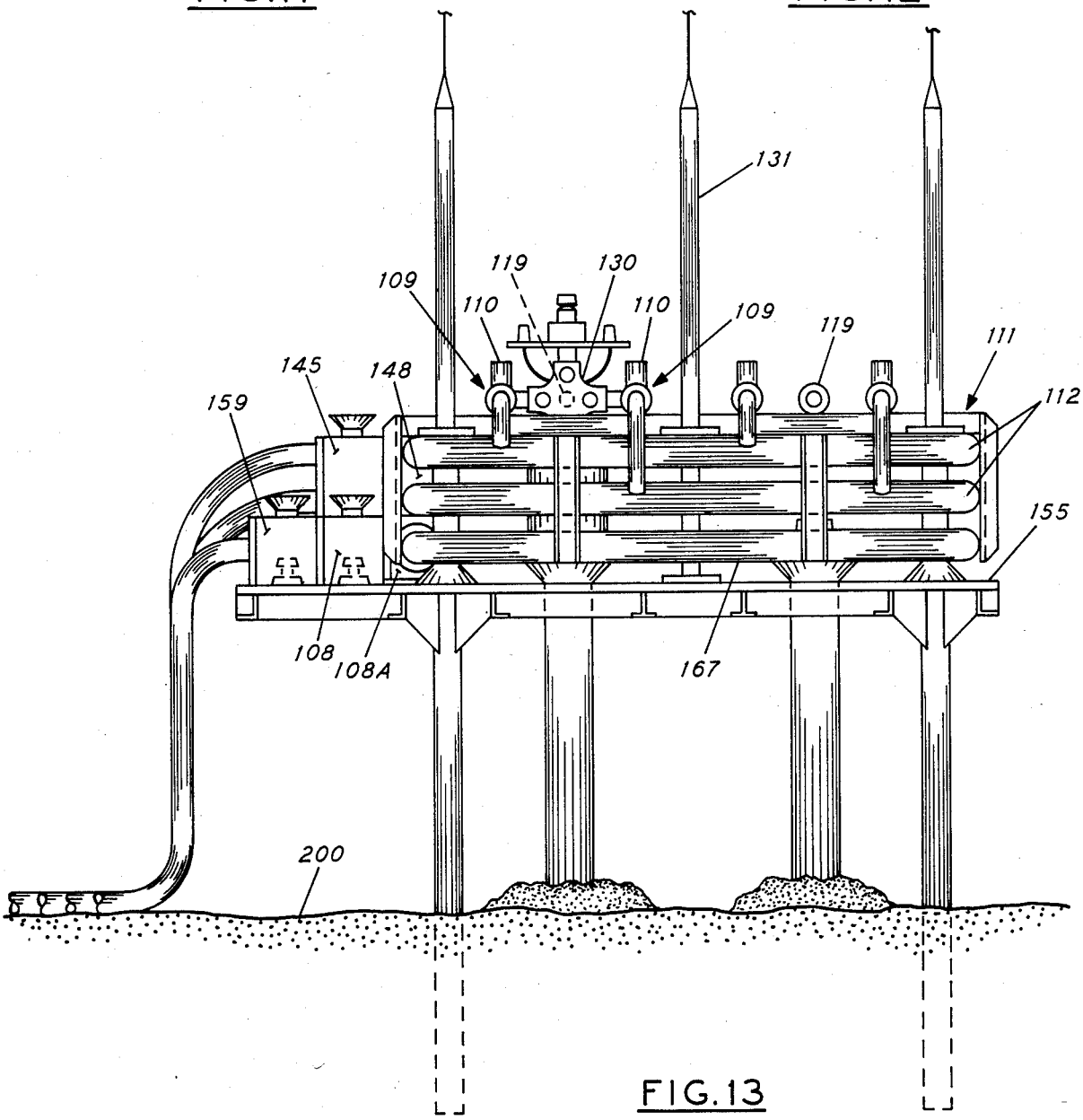
FIG. 13 shows an alternate embodiment of the present invention in which the drilling template is a base plate.

After the template is set into position on the underwater bottom, as illustrated in FIG. 2, drilling is conducted through any of a plurality of apertures 101 extending through the template, the vertical axes of the apertures being generally perpendicular to underwater bottom 200. The template is held in position on the underwater bottom by its own weight, or if necessary, the template may be anchored to the underwater bottom by means of piles, which are not shown. The template of the present invention may have any appropriate form different from the open tubular arrangement illustrated in FIG. 1. For example, as shown in FIG. 13, the drilling template may be in the form of a pile supported base plate 155.

After template 100 has been positioned on the underwater bottom, see FIG. 2, drilling will begin with the drilling of a conductor-pipe hole 135. To this purpose, a drill bit 127 is lowered, which is shown in phantom, by means of drill string 143 to pass through an aperture in the template. The drill bit is guided through the appropriate aperture by any suitable guidance means. As shown, the guidance means may comprise guide posts 131 which are fixedly connected to the template frame, guide lines 106 which are fixedly connected to the guide posts to extend to the surface, and guide arms 132. After drill bit 127 is positioned in the appropriate aperture, drill string 143 is rotated to form conductor-pipe hole 135.

Figure 3:
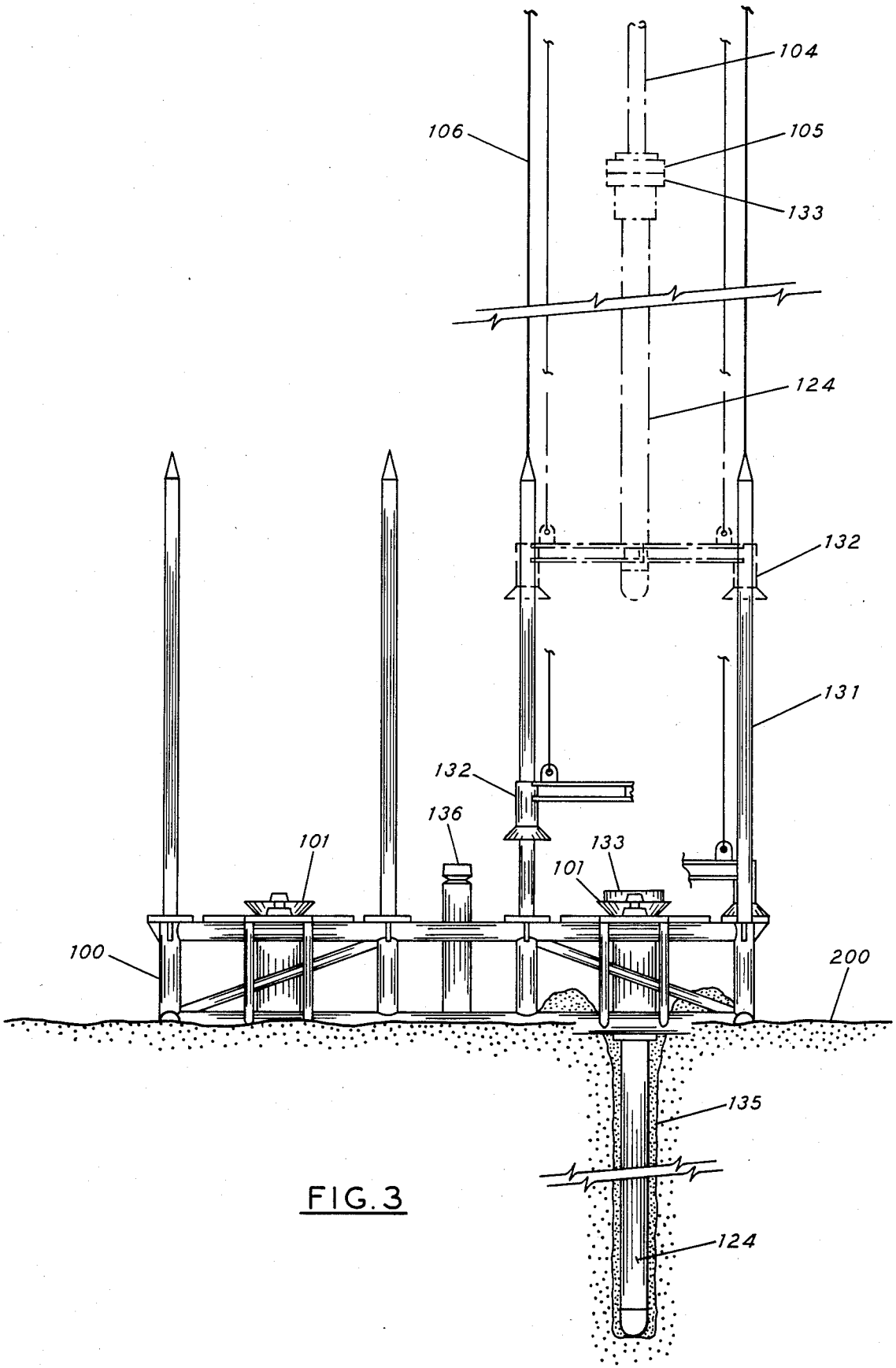
FIG. 3 illustrates a well casing being lowered and set into position in a wellbore.
Figure 4:
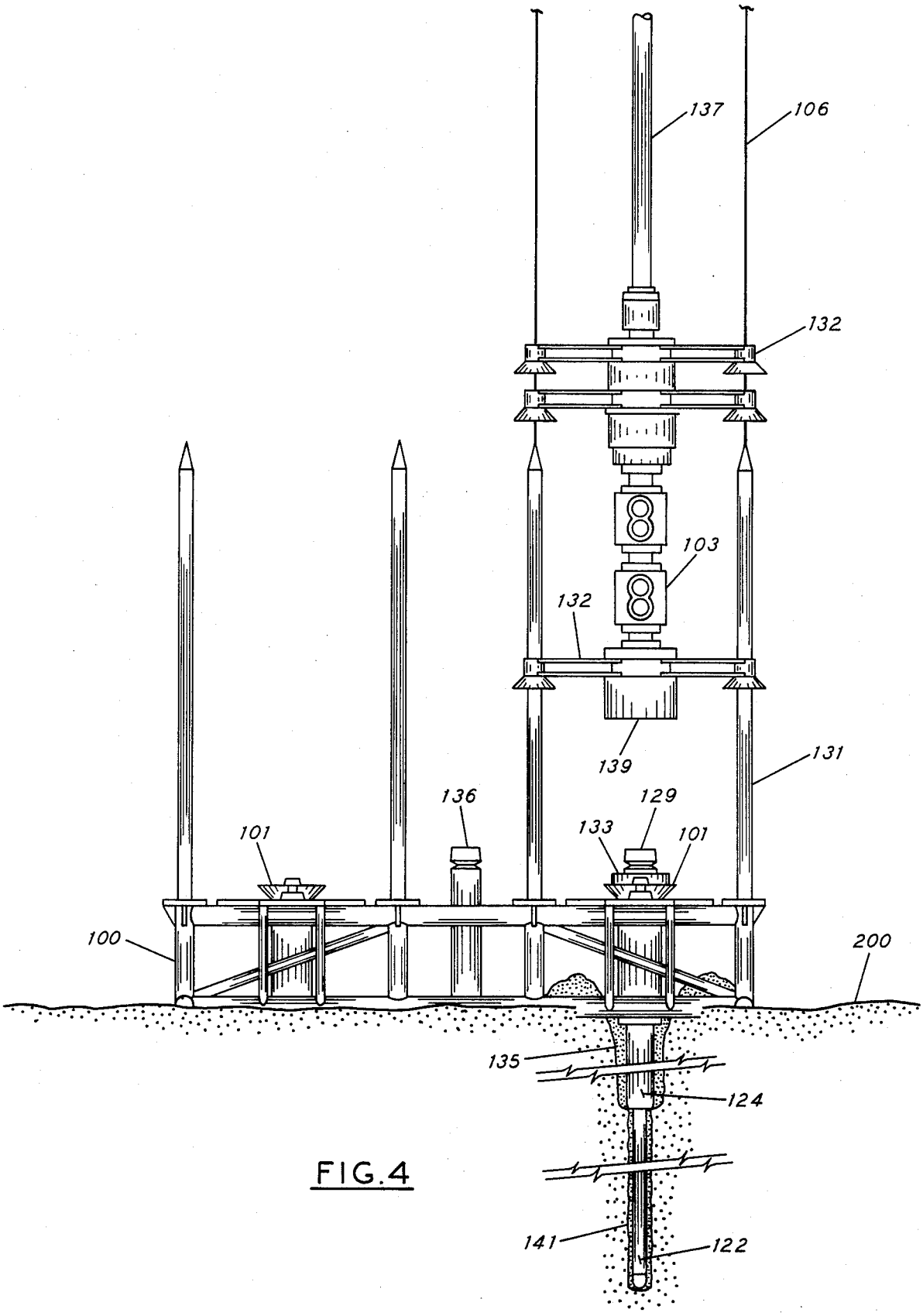
FIG. 4 shows a blowout preventer stack being lowered to the drilling template.

After hole 135 has been drilled to the desired depth, conductor pipe 124, see FIG. 3, is lowered, shown in phantom, to the sea floor by a pipe string 104, which is attached to conductor-pipe head 133 of pipe 124 by means of running tool 105. The conductor pipe 124 is guided through the appropriate aperture where it is set into hole 135 with conductor-pipe head 133 extending above the template frame. The conductor pipe is then cemented in place by conventional subsea cementing techniques. The next step in the drilling operation is illustrated in FIG. 4 wherein a rotary bit, which is not shown, is guided into conductor pipe 124 to drill a surface-casing hole 141. A surface casing 122 is then lowered into surface-casing hole 141 and cemented therein, casinghead 129 of surface casing 122 protruding through conductor-pipe head 133.

Figure 5:
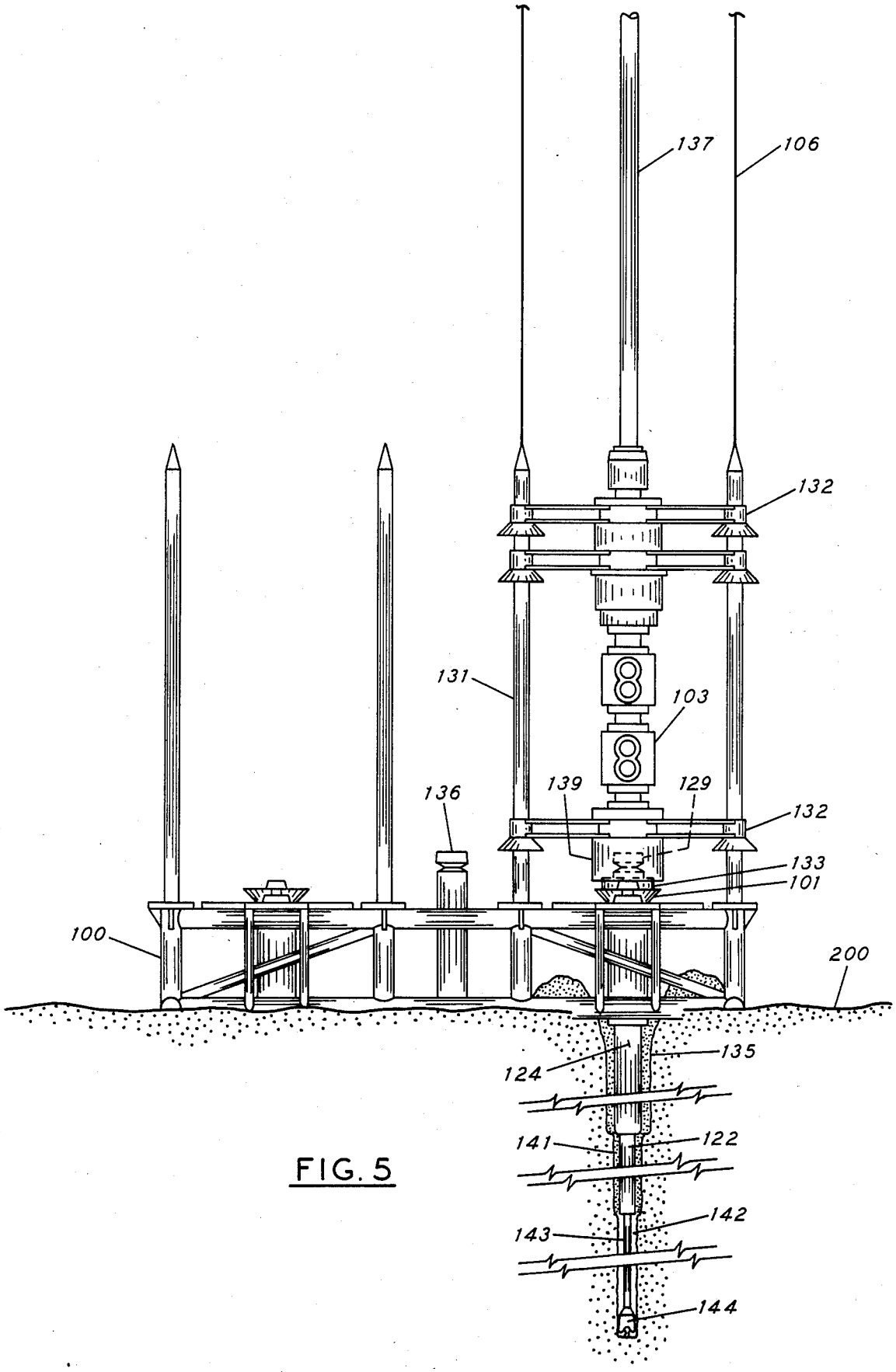
FIG. 5 shows the blowout preventer stack landed on the drilling template.

With surface casing 122 cemented in place, a blowout preventer 103 is then lowered to template 100 by means of a marine riser 137. The blowout preventer is latched into position on casinghead 129, as shown in FIG. 5, by any suitable means, such as hydraulic connector 139. With the blowout preventer in position, drilling is completed with the drilling—by means of drill string 143 and drill bit 144—of a production casing hole 142. After drilling of the production casing hole is completed, a production casing, which is not illustrated, is lowered into and cemented in production casing hole 142. Thereafter, production tubing is run in the wellbore and landed in casinghead 129. Well plugs are then lowered and secured in the tubing to prevent crude from escaping while other wells are being drilled and completed. With this done, the blowout preventer may removed and a well cap, not shown, may be installed on casinghead 129.

Figure 6:
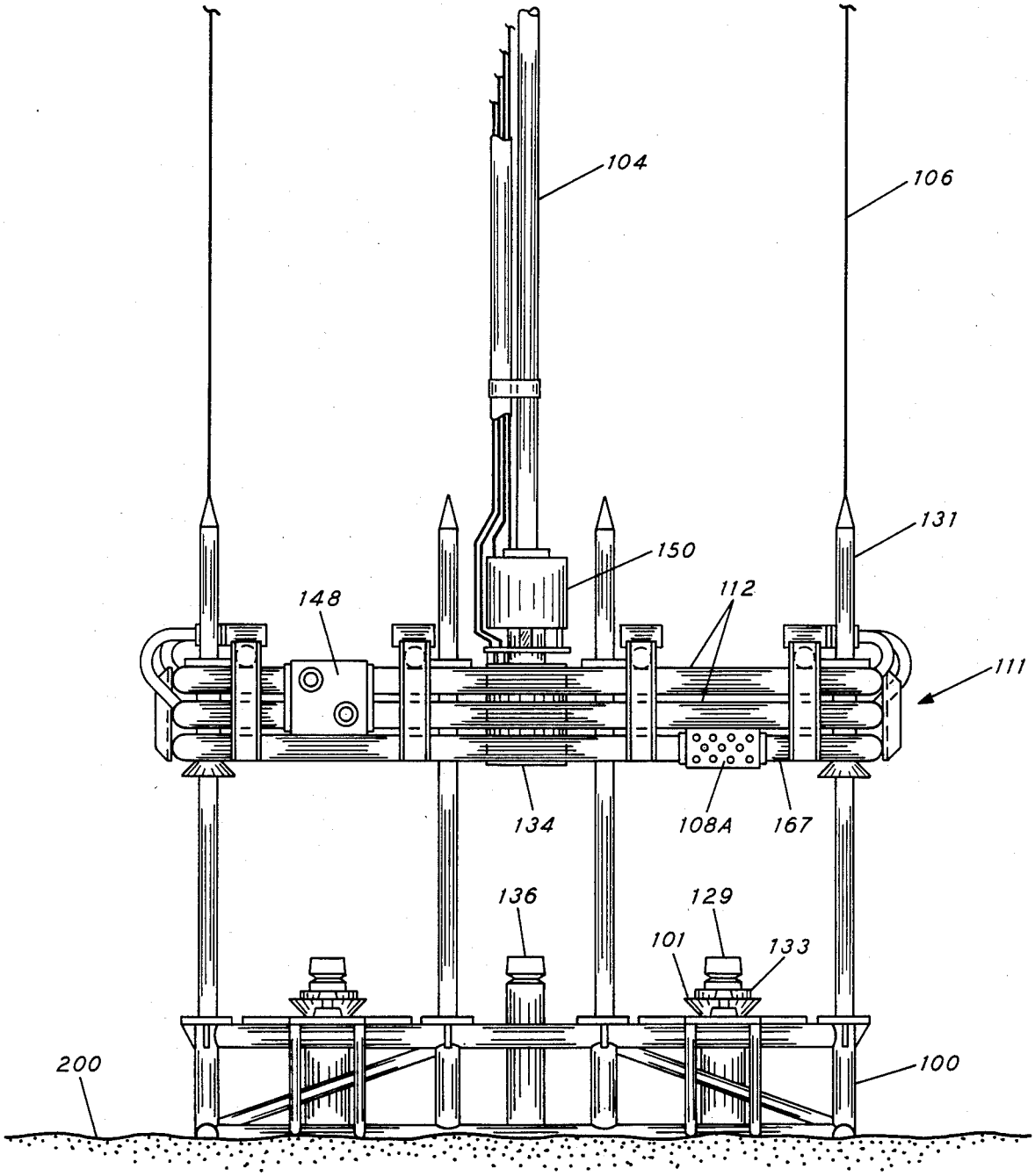
FIG. 6 illustrates the lowering of a production unit onto the drilling template.

The heretofore-described drilling procedure is repeated until the number of wells that are to be drilled at the particular site are completed. Once it has been established which and the number of wells that are to be produced, a production unit for producing oil and/or gas is readied for installation at the site. In this respect, it is expected that more than one well will be produced at any particular site, but it is noted that the present invention may be used where only one well is found to be commercially productive. As illustrated in FIG. 6, production unit 111 essentially comprises a flow manifold which includes manifold piping 112, protective piping 167 in which hydraulic control lines for the production system are run, production flow connector stab plate 148 that is part of the manifold piping, and control system stab plate 108A. Production unit 111 is lowered to the template by means of running string 104 and guided thereto by guide lines 106 and guide posts 131. The production unit is latched into position on the template by production unit-hydraulic connector 134 and production-connector mandrel 136, which is located on the template to mate with connector 134.

Figure 14:
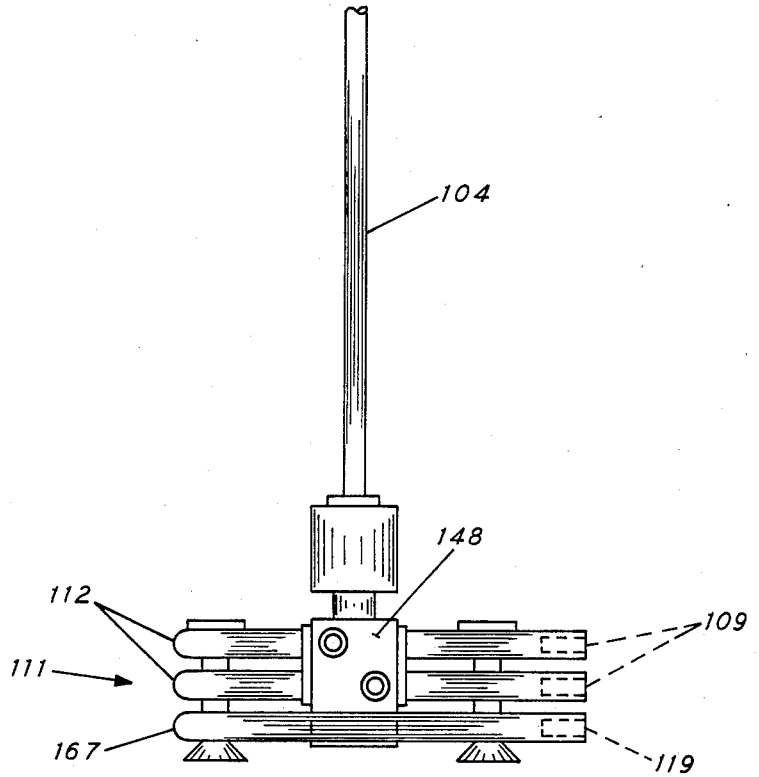
FIG. 14 shows an alternate embodiment of the present invention in which the production unit is lowered in sections with the sections being subsequently connected to each other.
Figure 14:
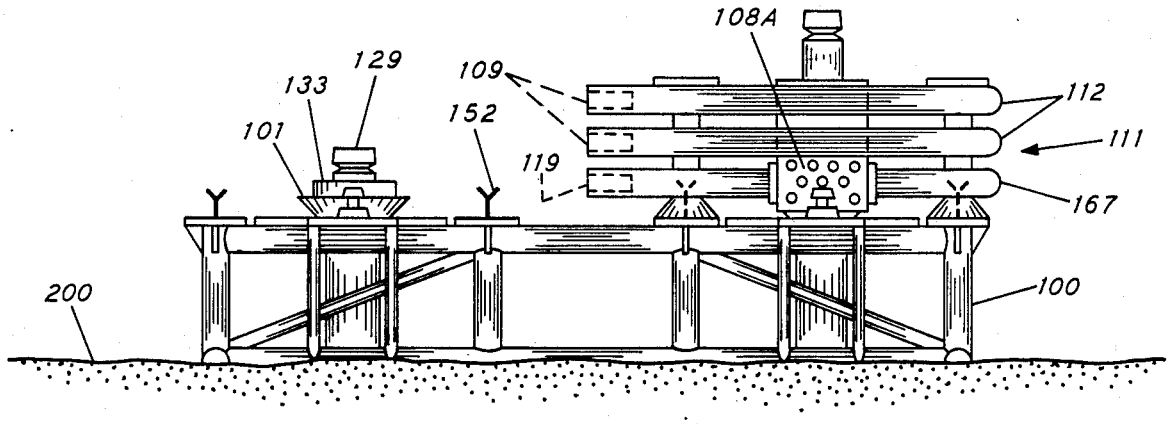

The above-described guidance system which uses guide lines and guide posts is but one means for guiding drilling and production equipment to the underwater bottom. Other guidance systems may be employed; for example, a guideline-less system that incorporates a television guidance system, a sonar system, or a transmitter-receiver system may be used. In FIG. 14, there is illustrated an arrangement for a transmitter-receiver system in which a transponder 152 is located on template 100 to receive a signal from a transmitter, which is not shown, to guide equipment onto the template. The other guidance systems that might be used are sonar and television systems. The television system, as is known in the art, essentially comprises a television camera which is suspended beneath the water's surface so that personnel at the surface may use the television image to guide equipment onto the template. The sonar system makes use of a sonar transponder that transmits and receives a signal reflected by a sonar reflector located on the template. Of course, it would also be possible to use one type of guidance system in combination with another; for example, the guidance system may consist of both television and sonar equipment.

Figure 7:
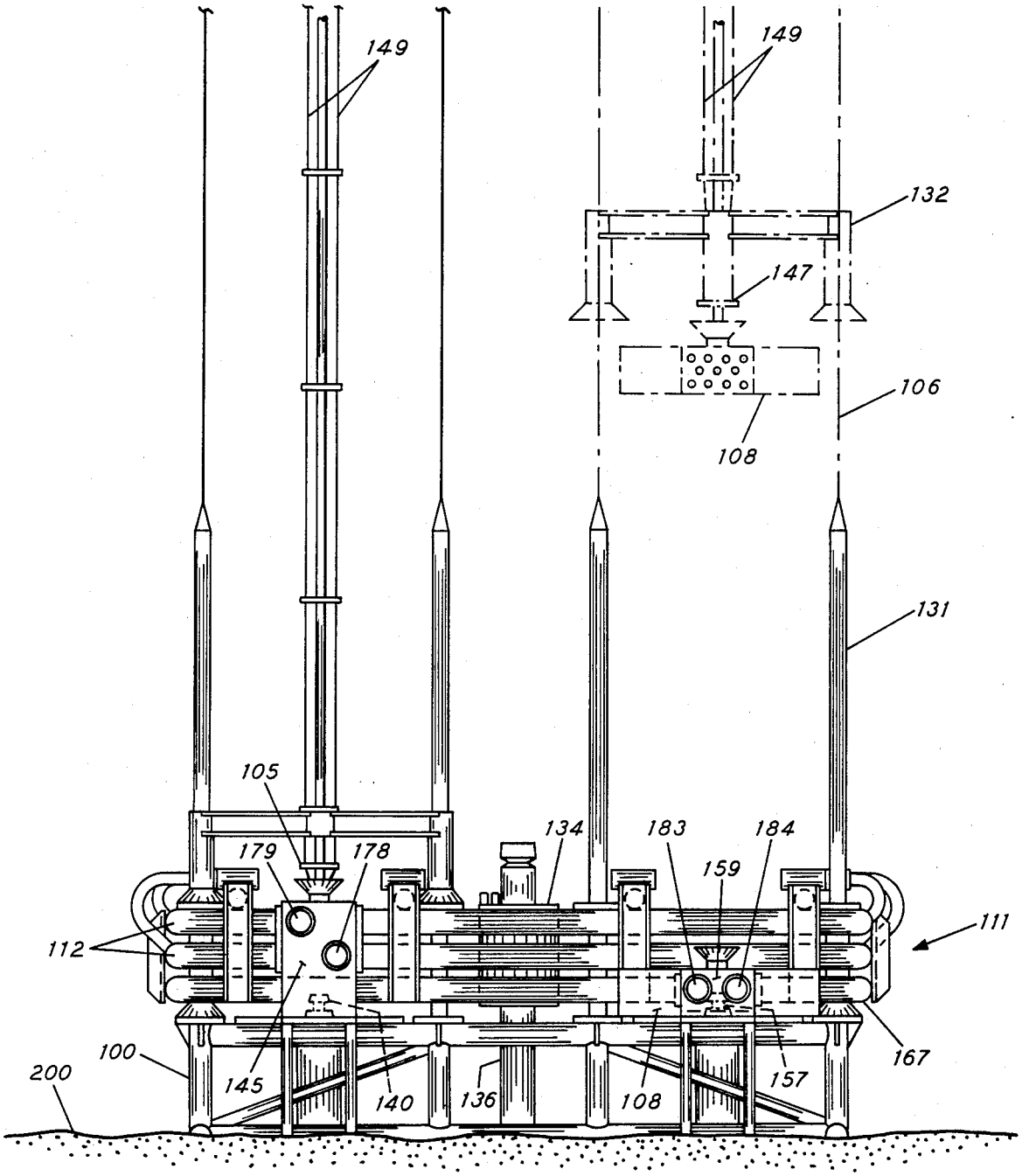
FIG. 7 shows the production unit connected onto the drilling template with production pipelines connected to the production unit. This Figure also shows a control pod being lowered and set into position on the template.
Figure 11:
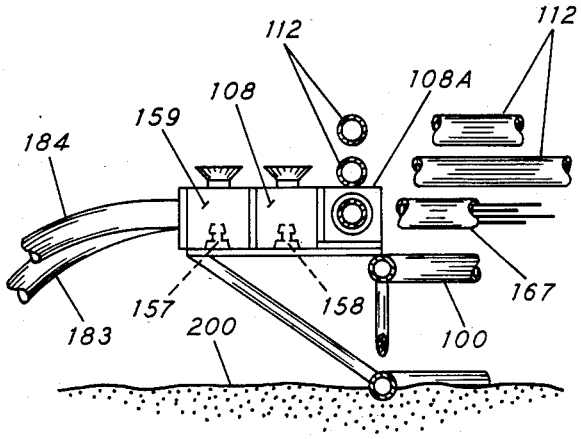
FIG. 11 is a sectional view taken along line 11—11 of FIG. 10 which illustrates the connection of the control lines to the control pod.
Figure 12:
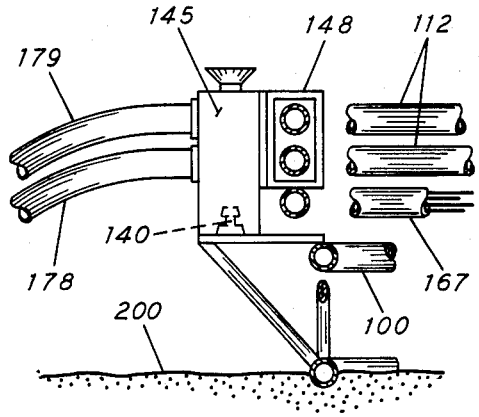
FIG. 12 is a sectional view taken along line 12—12 of FIG. 10 which shows in greater detail the connection of the production pipelines to the production unit.

Now referring to FIGS. 7 and 11, after production unit 111 has been positioned on the template, a running tool 147 is used to lower a control system pod 108 to the template. Hydraulic installation lines 149 are attached to the running tool and extend from the running tool to the surface where they are connected to a hydraulic power unit. Once the control pod is guided into position on the template, the hydraulic power unit at the surface is activated to actuate latches within the control pod to connect the pod to a mandrel 158, see FIG. 11. A suitable hydraulic and electric connector, which is not illustrated, is located within pod 108 for operatively connecting the pod to control system stab plate 108A on the production unit. This arrangement permits the production unit to be disconnected from the control pod in situations where the production unit or the control pod is to be removed from the template.

Figure 10:
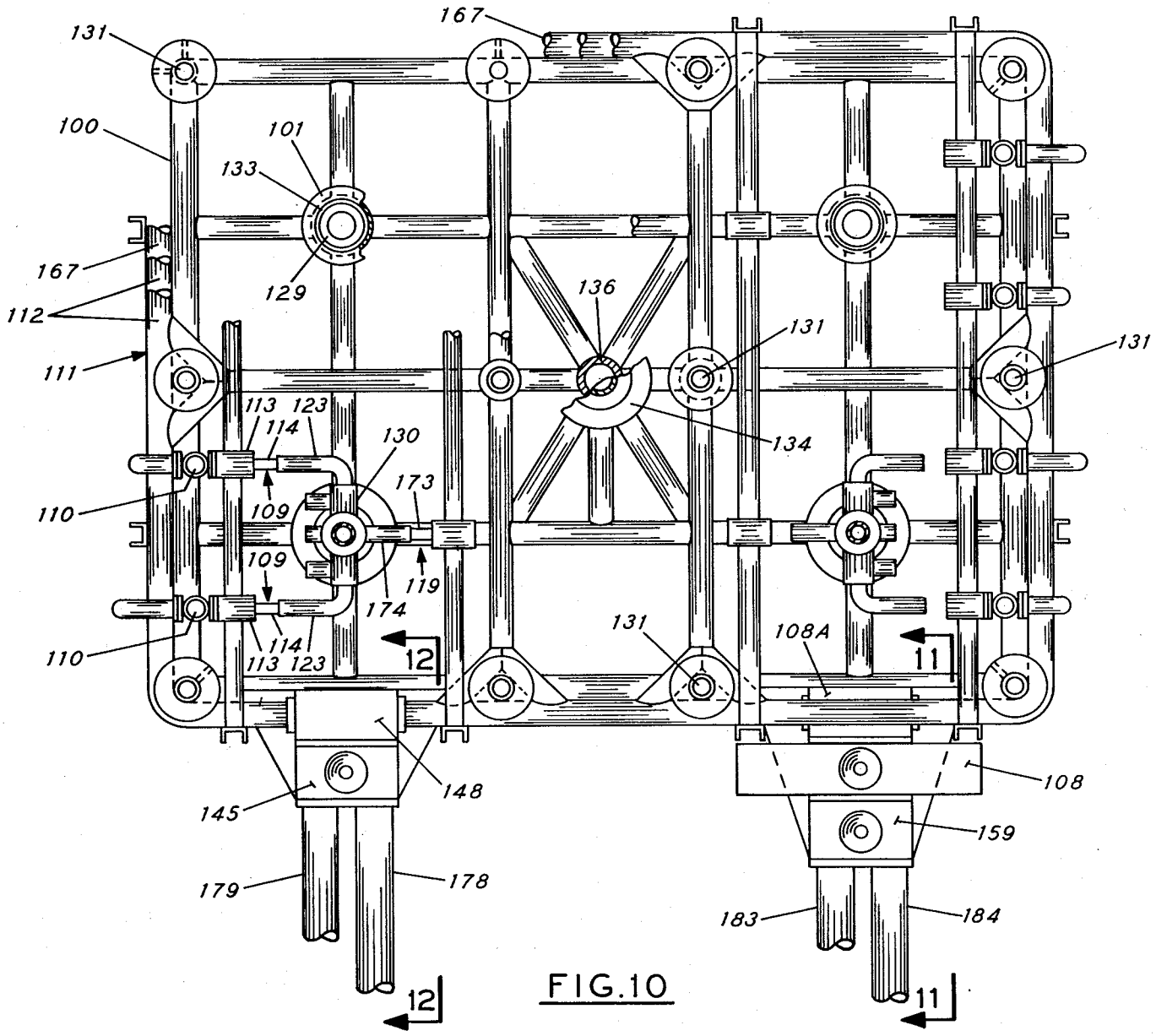
FIG. 10 is a plan view taken along line 10—10 of FIG. 9.

The power source at the surface, which is not illustrated, for operating the control pod is in communication with the control pod through hoses or cables 183 and 184, see FIGS. 10 and 11. Hoses 183 and 184 are connected to the control pod through a control line connector 159, which is connected to the template by means of a mandrel 157. It is noted that hoses 183 and 184 may either be connected to the control line connector to be orientated along an essentially vertical axis as illustrated or, alternatively, to be orientated along an essentially horizontal axis. It is further noted that connector 159 is lowered to the template in a manner similar to that of the lowering of control pod 108.

Figure 8:
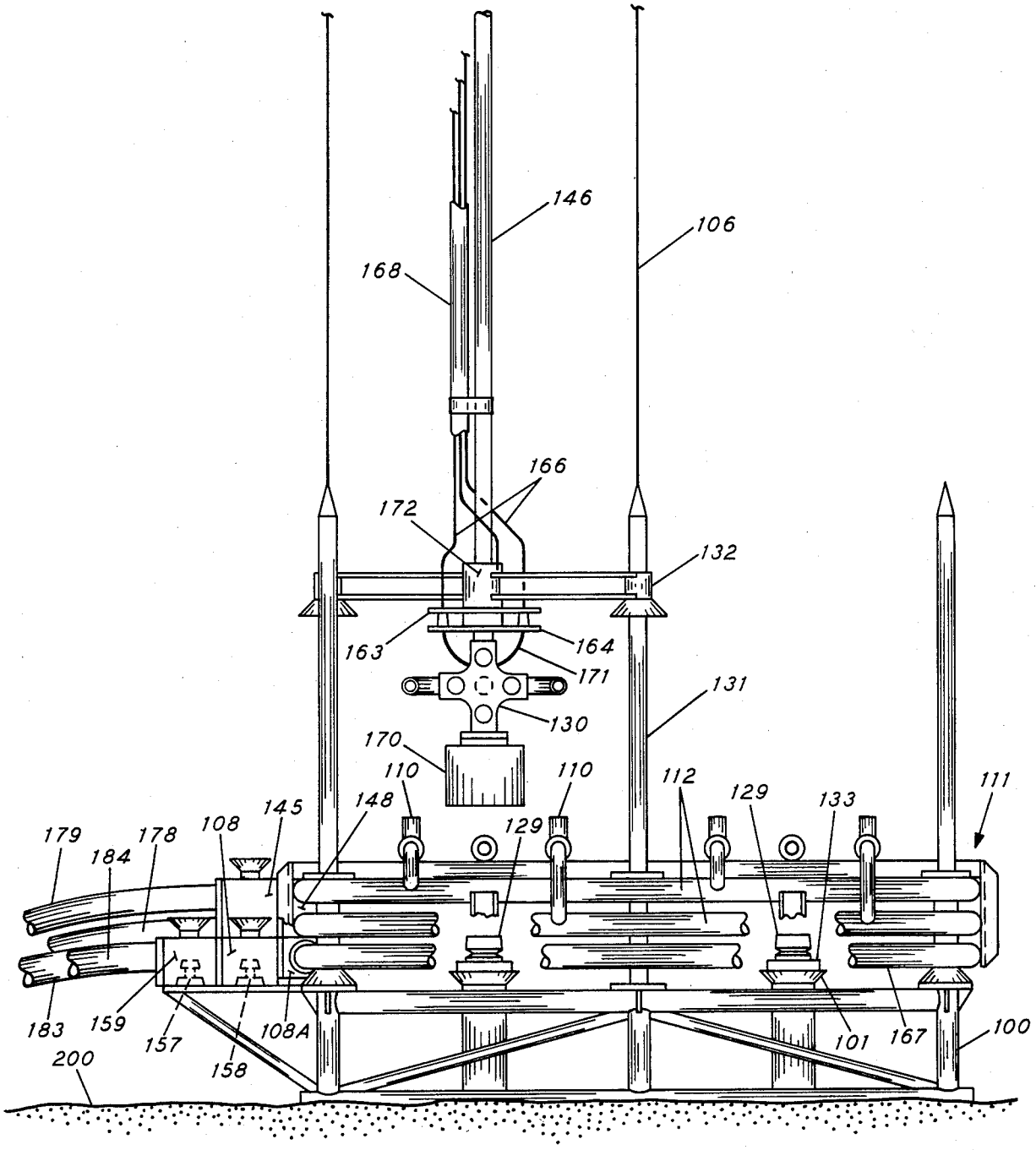
FIG. 8 is a view illustrating a Christmas tree being lowered onto that portion of the well casing extending through the drilling template.
Figure 9:
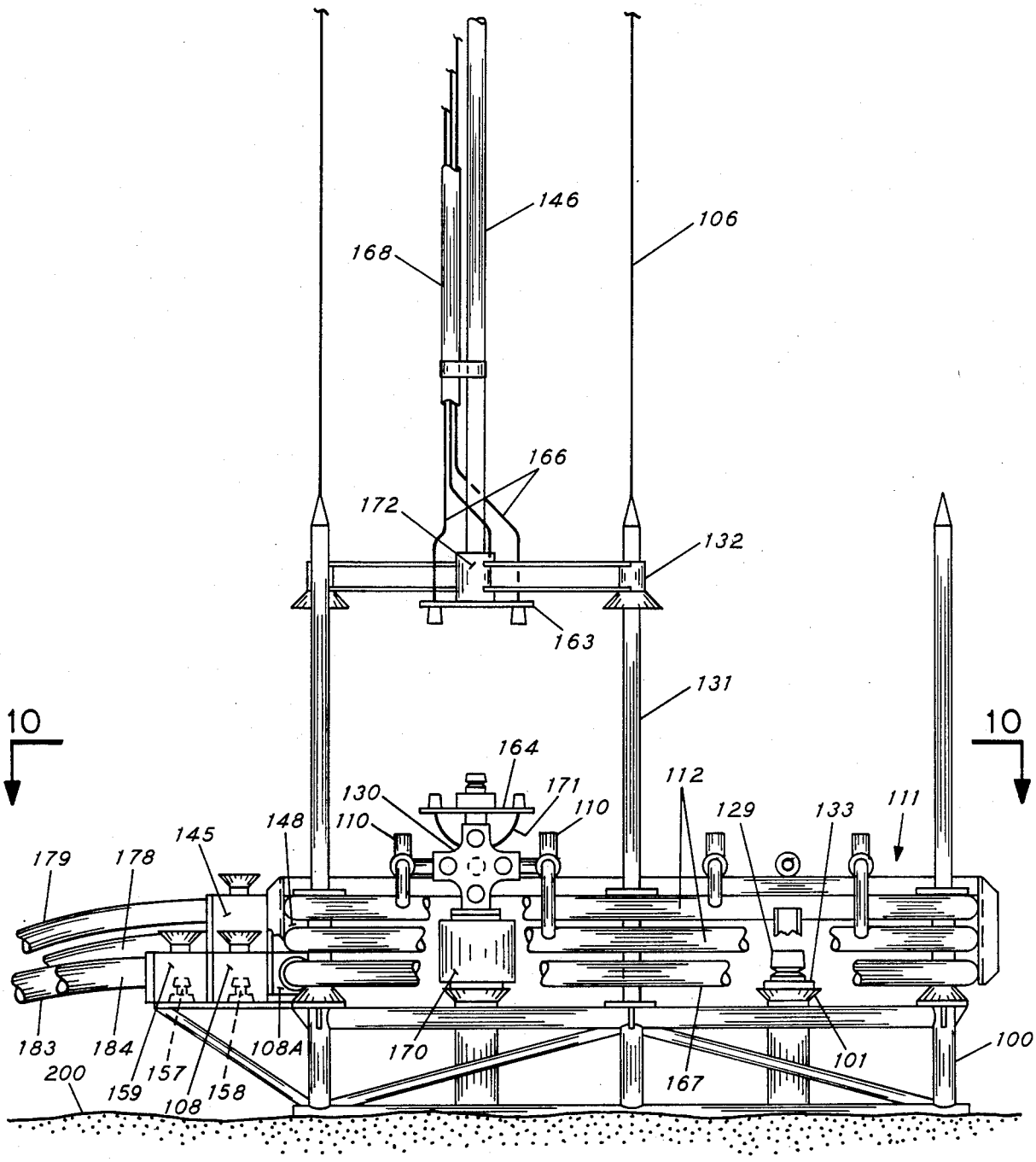
FIG. 9 shows the Christmas tree connected to both the production unit and that portion of the well casing extending through the drilling template.

The control pod contains the necessary pilot valves, which are preferably hydraulically actuated but which may be pneumatically or electrically operated or some combination thereof, for controlling production, that is, for controlling the operation of production unit 111 and Christmas trees 130, see FIG. 8. As discussed heretofore, control pod 108 is connected to control stab plate 108A. The stab plate in turn is connected to hydraulic control lines that are run in protective piping 167 of the production unit, see FIG. 11. Some of the control lines in piping 167 are also connected to the Christmas trees through a control line connector 119, which will be discussed in more detail below. In this manner, control pod 108 is in communication with the respective Christmas trees to establish a control system for the trees.

As illustrated in FIGS. 7–10 and 12, the present invention further includes production pipelines 178 and 179 in communication with manifold piping 112. The production pipelines carry oil and/or gas production away from the production unit. The production pipelines are connected to production flow stab-plate 148 of manifold piping 112 through of a pipeline connector 145. The pipeline connector is operatively connected to production flow stab-plate 148 and latched onto the template by means of mandrel 140. As in the case of control pod 108 and stab plate 108A, pipeline connector 145 is connected to stab plate 148 in a manner that permits the production unit to be disconnected from connector 145 for the purpose of removing the production unit. The method of connecting pipelines 178 and 179, either exiting the flow manifold horizontally or vertically, to pipeline connector 145, as in the case of connecting hoses 183 and 184 to control line connector 159, may be any appropriate method. And since such methods are well known in the art, they are not described in any detail.

With the production unit in place on the template, Christmas tree 130 may be lowered, see FIG. 8, onto casinghead 129 to be connected thereto. By way of explanation, the Christmas trees are an assemblage of control valves, pressure gauges and chokes located at the top of a well to control the flow of oil and gas from the well. The Christmas trees may also include fittings suitable for use in pumping and assisted recovery operations.

The Christmas tree is lowered and positioned on the template by means of a completion riser 146 and the above-discussed guidance system. The Christmas tree is connected to the completion riser by a remotely-operated, hydraulic connector 172. Connector 172 includes a stab-receiver plate assembly having a female portion 163 and a male portion 164. The female portion is connected to hydraulic lines 166 of hose bundle 168 and mates with the male portion. The male portion is mounted on the Christmas tree where it is connected to a hydraulic valve operator on the tree. After the Christmas tree has been latched into position on casinghead 129, the valve operator on the tree may be actuated to disconnect female portion 163 from male portion 164. This permits connector 172, hose bundle 168, and female portion 163 to be raised from the subsea bottom.

After the Christmas tree has been lowered onto the appropriate casinghead 129, it is disconnectably connected thereto by a connector 170, which is affixed to the lower end of the Christmas tree. The Christmas tree may then be placed in communication with manifold piping 112 through a flowline connector 109, which is described in greater detail below. The flowline connector and block valves 110, which prevent the flow of production out of manifold piping 112, see FIG. 10, are operated by control pod 108 to establish a flow path between the Christmas tree and manifold piping 112. A control-line connector 119, which is also operated by control pod 108 and which is described in greater detail below, is provided to establish a control circuit between the Christmas trees and the control pod through the lines in piping 167. It is understood that for operation of valves 110 and connectors 109 and 119 by control pod 108, appropriate control lines are run from the control pod and through piping 167 and associated piping to connect to the aforementioned valves and connectors.

In the present invention, a Christmas tree is provided at each well from which hydrocarbons are to be produced, and it is understood that any Christmas tree may be disconnected from the production unit by means of flowline connector 109 and control-line connector 119. That is to say, flowline connector 109 may be operated to disconnect any Christmas tree from manifold piping 112, and control-line connector 119 may be operated to disconnect the tree from the control lines in piping 167. When this is done, production from the disconnected well into the production unit is stopped, and the control circuit between control pod 108 and the Christmas tree is broken. When the flowline and control-line connectors are operated to disconnect any Christmas tree from the production unit, that tree—or trees—may be removed from its casinghead without removing the production unit. Likewise, the arrangement of the flow-line and control-line connectors permits the production unit to be disconnected from each of the Christmas trees so that the production unit may be removed from the template without first removing any of the Christmas trees. As is known in the art, appropriate means is provided at each casinghead 129 to prevent the flow of production out of the well when a tree is removed from its casinghead. Further, it is understood that when the production unit is disconnected from the Christmas trees, the valving on the trees is operated to stop the flow of production from the wells.

Figure 15:
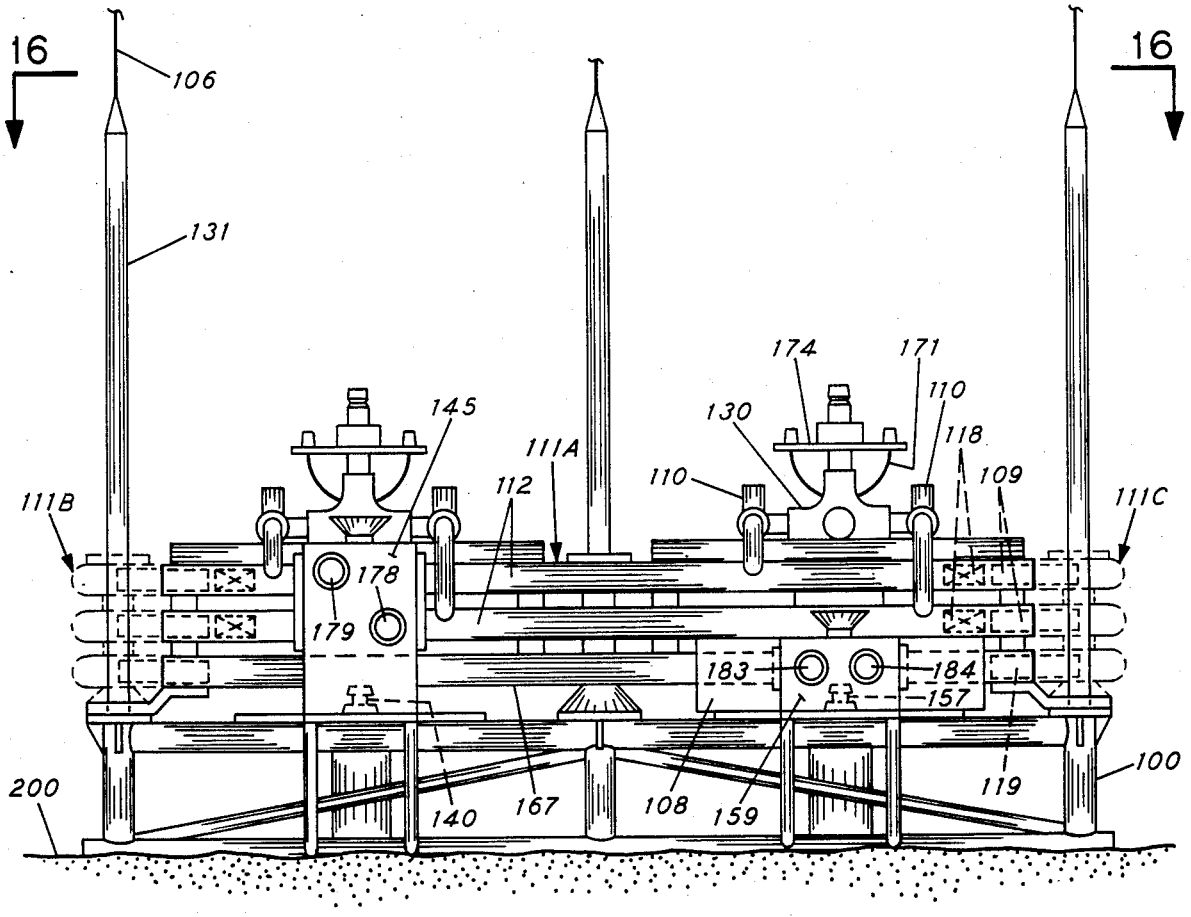
FIG. 15 is a schematic view showing an alternate embodiment of the present invention in which oil is being produced into one section of a production unit wherein additional sections of the production unit may be lowered at a later time to produce additional wells.
Figure 16:
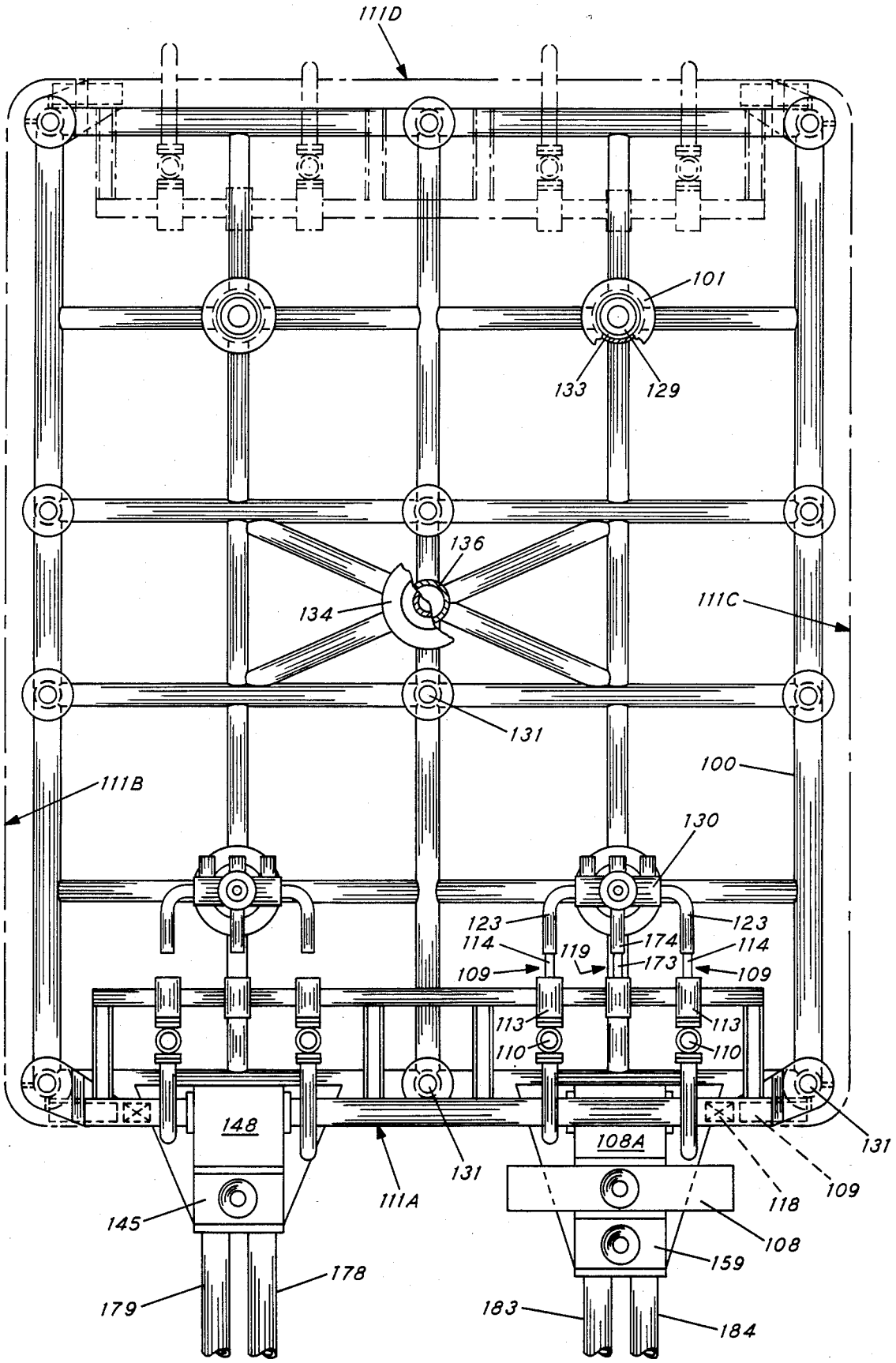
FIG. 16 is a plan view of FIG. 15 taken along lines 16—16.

With reference to FIGS. 15, 16, and in particular 18, a detailed description of the operation and construction of flowline connector 109 is provided. The flowline connector is located on the production unit and essentially includes an inner sleeve 114 coaxially positioned and slidably movable within an outer sleeve 113. A fluid channel 126 extends through the inner sleeve and a piston 117 is formed at that end of the inner sleeve located in the outer sleeve. The opposite end of the inner sleeve is adapted to slidably engage a flow-line connector receiver 123 which is located on each Christmas tree. Outer sleeve 113 has ports 115 and 116 located at opposite ends thereof. These ports are connected by suitable lines of communication through piping 167 to control pod 108. The control pod thus controls the operation of the flowline connector by regulating the flow of fluid to ports 115 and 116. To explain more fully, when control pod 108 is operated to flow hydraulic fluid through port 115, a fluid pressure will act on one face of piston 117. This will cause the inner sleeve to move within the outer sleeve in a direction away from port 115 and towards receiver 123, exhausting any fluid on the opposite side of piston 117 through port 116. Conversely, when control pod 108 is operated to flow fluid through port 116, a fluid pressure will act on the opposite face of piston 117. This causes the inner sleeve to travel in a direction towards port 115 and away from receiver 123, exhausting fluid through port 115.

As indicated, the production flowline connector is located on the production unit, see FIG. 10, where one end of outer sleeve 113 is connected to block valve 110. The block valve prevents the flow of hydrocarbons out of piping 112 where the manifold is not connected to a Christmas tree. Alternatively, it is noted that the block valve may be a valve means arranged in the flowline connector itself. By operating a flowline connector at a particular Christmas tree, a flow path may be established between the tree and the manifold piping. This occurs when inner sleeve 114 engages receiver 123 located on the Christmas tree. Block valve 110 may then be opened to place the Christmas tree in productive association with the production unit. Production is thus free to flow from the well and through outlet 126 of the flowline connector and into manifold piping 112.

If it becomes necessary to remove one or all of the Christmas trees from the well site, block valve 110 associated with the tree or trees to be removed is closed. The flowline connector is then operated to retract sleeve 114 from receiver 123. The Christmas tree or trees to be removed are now disconnected from the manifold piping. Each Christmas tree may then be disconnected from its respective casingheads to be raised to the surface. From the above, it can be seen that any Christmas tree may be retrieved from the underwater bottom without having to remove the production unit or any other Christmas tree. In a like manner, all the Christmas trees may be disconnected from the production unit, so that the production unit may be removed from the template without first having to remove any of the Christmas trees.

In removing any Christmas tree or the production unit from the template, it would also be necessary to disconnect the control circuitry in the Christmas trees from the control system of the production unit. To this purpose, a control-line connector 119, see FIGS. 10, 15, 16, and 19, is provided. The control-line connector functions to establish a means of communication between control pod 108 and the control circuitry of the respective Christmas trees, and it operates in a manner similar to that of the flow-line connector. As discussed, the control pod is connected to stab-plate 108A from which control lines are run in piping 167 and 167A to the control-line connectors 119 located at each tree. The control-line connector is located on the template and has an inner sleeve 173 coaxially positioned and slidably movable within an outer sleeve 199. The control-line connector is positioned so that its inner sleeve may engage a control line receiver 174 located at the Christmas tree. The control line connector is operated by control pod 108 by regulating the flow of hydraulic fluid through ports 169 and 177 which extend through and are located at opposite ends of outer sleeve 199. A fluid flowing through port 169 will exert a fluid pressure on piston 180 of inner sleeve 173 to cause the inner sleeve to move towards and engage receiver 174. To retract sleeve 173 from receiver 174, a fluid will be flowed through port 177 to exert a fluid pressure on the piston that causes the inner sleeve to move in a direction away from receiver 173.

Figure 19:
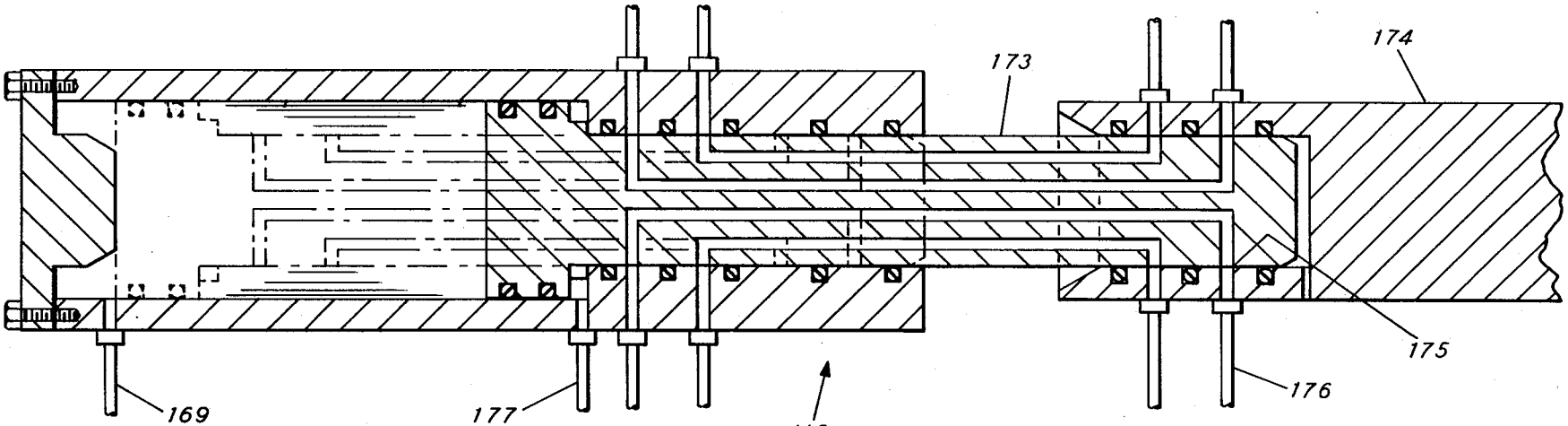
FIG. 19 shows an embodiment of a hydraulic control line connector used to connect the Christmas tree control system to the hydraulic control lines in the production unit. The hydraulic control line connector may also be used to connect the hydraulic control lines in one production unit section to those in another production unit section.
Figure 18:
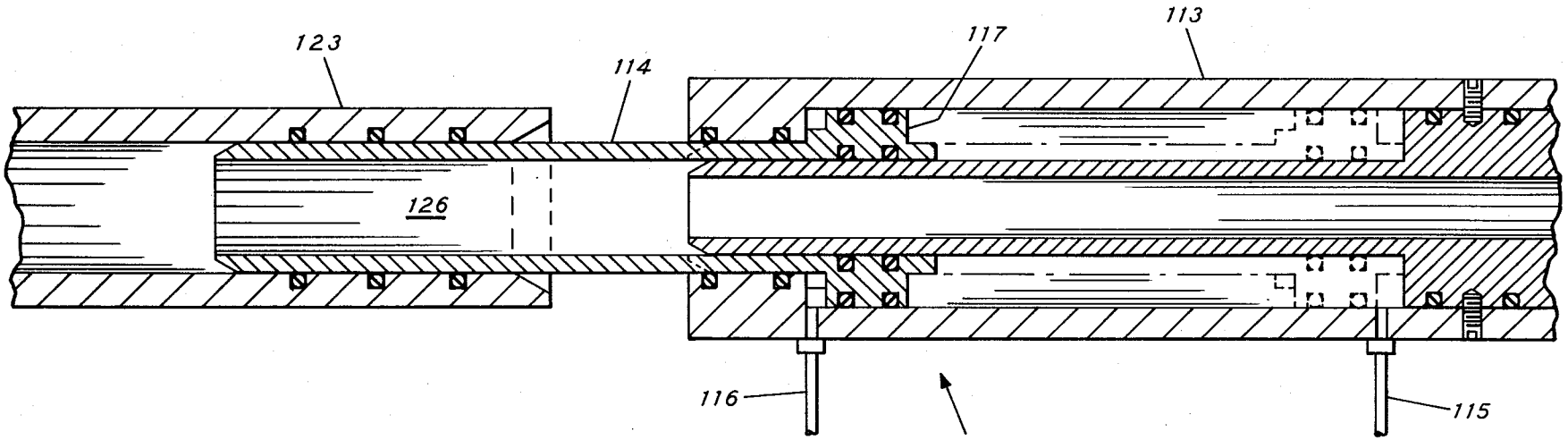
FIG. 18 shows an embodiment of a flowline connector which connects the Christmas trees to the production unit or connects sections of the production unit together so that oil or gas flows from the well to the production manifold.

Control lines 181, 182, 183, and 184, see FIG. 19, are run in piping 167 and 167A for operation of the respective Christmas trees. The control lines terminate at the control-line connector where they are each in communication with a respective port that extends through outer sleeve 199. When inner sleeve 173 operatively engages receiver 174, control lines 181 through 184 are aligned with channels 191, 192, 193, and 194, respectively, in inner sleeve 173. In turn, channels 191 through 194 are aligned with control lines 181*a*, 182*a*, 183*a* and 184*a*, respectively, of receiver 174. In this manner, a control circuit is established between control pod 108 and the Christmas trees. To remove any Christmas tree from its casing-head or the production unit from the template, the control circuitry of the Christmas tree must be disconnected from the control lines in the production unit. To accomplish this, control pod 108 is operated to flow fluid through port 177 which, as discussed, causes sleeve 173 to be withdrawn from receiver 174. Thus, the control circuitry in the Christmas trees may be disconnected from the production unit so that any tree or trees may be removed without removing the production unit. Likewise, the control circuitry in the production unit may be disconnected from each of the Christmas trees so that the production unit may be removed from the template without first removing any of the trees.

It is noted that should the control circuitry in control pod 108 be something other than the above-described hydraulic system—for example, a pneumatic or electrical system—connector 119 could be modified to establish the appropriate electric or pneumatic lines of communication. For instance, if an electric control circuit is used, electrical wiring rather than hydraulic lines would be run from control pod 108 and through piping 167 and 167A to the control-line connector. Further, it is noted that it would be possible to construct the control-line and flowline connectors as a single unit. Such a unit is illustrated in FIG. 17 wherein hydraulic control lines 120 and flowlines 121 from the production unit are connected to a single flowline-control-line connector 138.

The present invention may also be used in production operations in which the production unit is composed of a number of individual sections. For example, in FIG. 14 there is illustrated a production unit comprised of two different sections 111X and 111Y. Section 111X includes control stab-plate 108A and section 111Y includes flow stab-plate 148. After sections 111X and 111Y are positioned on the template, production piping 112 of the two sections are disconnectably connected into operative assocation by the heretofore-described flowline connector 109. To this purpose, inner sleeve 114 of the flowline connector is located on one production unit section to engage receiver 123 located on another production unit section. Similarly, the control lines in piping 167 in the two different sections are operatively connected by control-line connector 119. Here, inner sleeve 173 of the control-line connector is located on one production unit section to engage receiver 174 located on another production unit section. Once production unit sections 111X and 111Y are in place on the template and the two sections are connected in operative association, they will function as a single production unit.

Another production system is illustrated in FIGS. 15 and 16. In this arrangement, a first production unit section 111A is positioned on the template to produce a number of wells. Production unit section 111A is complete as it includes all the means necessary for flowing and controlling production. That is to say, it includes control stab-plate 108A and flow stab plate 148 of the manifold piping. Additional production unit sections 111B, 111C and 111D, shown in phantom, may subsequently be put into operation to produce additional wells. These additional sections need not include a control stab-plate or flow stab plate as these sections will be connected in operative association with section 111A. The production unit sections have block valves 118 located at each end of manifold piping 112 to close the piping off to the sea when the production unit section is not connected into operative association with another production unit section. Outwardly of block valves 118 are the appropriate flowline connectors 109, and in piping 167, the appropriate control-line connectors 119. As discussed, connectors 109 and 119 allow the various production unit sections to be connected into operative association. As illustrated, production is carried away from the production unit sections by production pipelines 179 and 178 which are connected to production unit section 111A. Likewise, control cables 183 and 184 for control of the production system are connected to production unit section 111A. With section 111A in place, other production unit sections may be added to or removed from the template without disrupting production flowing into section 111A and the other sections connected into operative association therewith.

Figure 17:
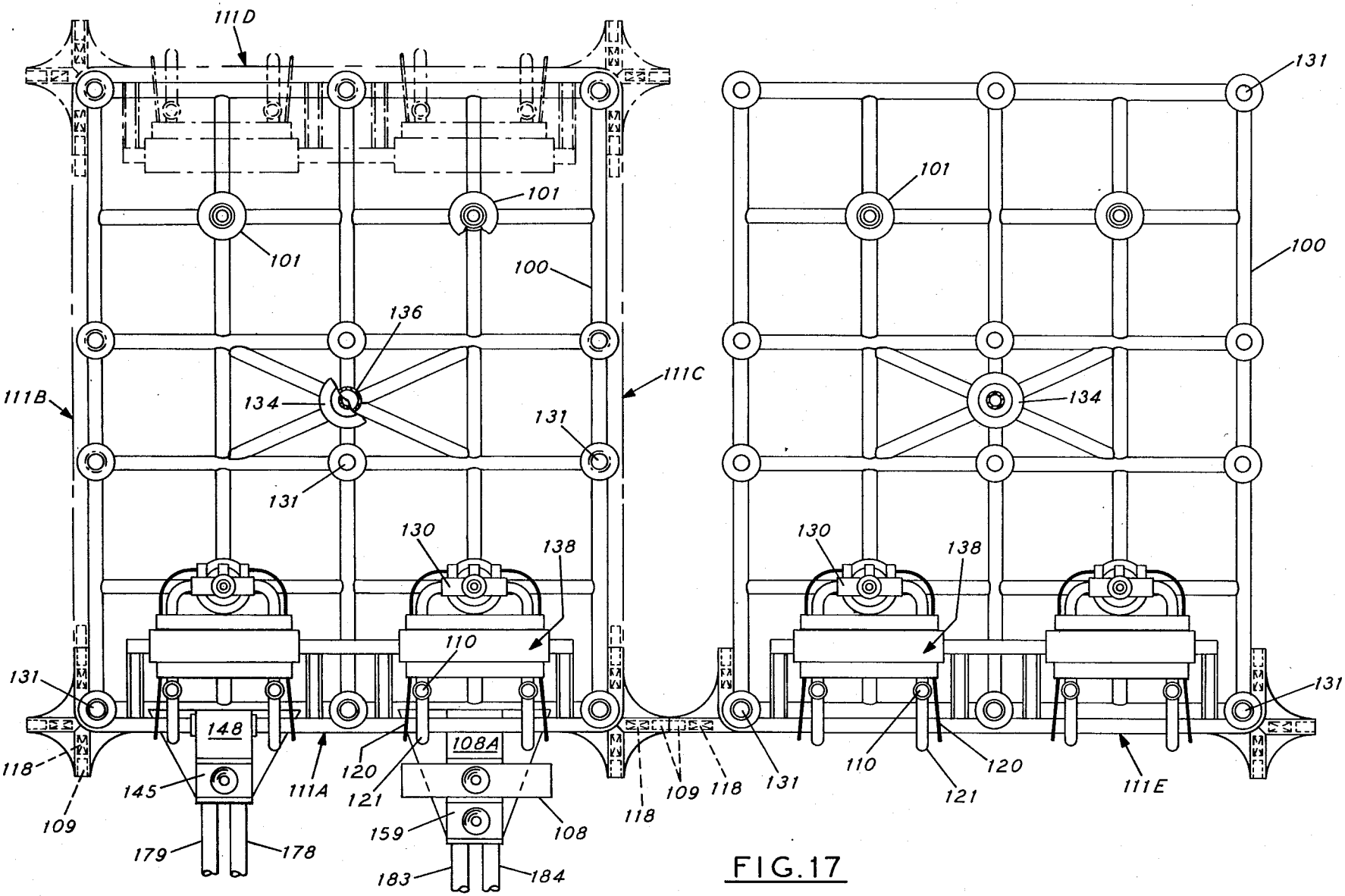
FIG. 17 shows in plan view an embodiment of the present invention in which oil or gas is produced into one section of a production unit as shown in FIGS. 15 and 16 wherein other production unit sections located on a separate drilling template may be connected thereto as additional wells are produced.

FIG. 17 illustrates a production operation in which a number of wells may be produced by production unit sections located on different templates. Here production unit section 111A includes all the means necessary for flowing and controlling production so that as additional wells are produced from production units located on different templates, they may be connected into operative association with unit section 111A. For example, where additional wells are drilled from template 100, production unit section 111E located on that template may be connected into operative association with section 111A by flowline connector 109 and control-line connector 119. As in the previously-described operation, block valves 118 are provided on units 111A and 111E to close-off piping 112 to the sea prior to connecting production unit section 111A to production unit section 111E.

SUMMARY OF THE ADVANTAGES

A significant feature of the present invention is the ability to remove any Christmas tree from its casinghead without having to remove the production unit or any other Christmas tree. Thus, production is only disrupted at the well from which the tree has been removed. Similarly, the production unit may be disconnected from each of the trees to be moved from the template without first having to remove any of the Christmas trees. After the production unit is removed, it could be serviced at an above-water site while a replacement unit is put into operation. These advantages lead to reduced maintenance costs as well as a more efficient method of producing oil and gas.

The use of this invention also reduces the initial expenditure for drilling operations as no unnecessary investment in production equipment is made. This is because the necessary production equipment is not committed to the particular drilling site until the actual extent the reservoir is known.

Moreover, with the present invention, different production unit sections may be positioned on the same or different templates to be connected into operative association with each other. This offers additional flexibility in production operations. For as additional wells are developed, additional production unit sections may be committed to the operating site and connected into operative association with the previously committed production unit sections.

The foregoing describes selected embodiments of the present invention in detail. The invention, however, is not to be limited to any specific embodiment, but rather only by the scope of the appended claims.

What is claimed is:

1. A subsea drilling and production system having separate independent units for each wellhead capable of being remotely installed and removed independent of one another by hydraulic control lines operable at the surface of a body of water, comprising:

a drilling template positioned on the bottom of a body of water, said template having a plurality of apertures through which wells may be drilled;

a casing head established at each well drilled through said template;

a Christmas tree for each well removably connected to said casing heads;

remotely operable means for removably connecting said Christmas tree to said casing head;

a production unit for each well removably connected to said template, said production unit including manifold piping and control means, said manifold piping including piping involving production handling, annulus access, gas and fluid lift, gas and fluid injection, pressure maintenance, and said control means including electrical cables and hydraulic piping for signal and energy transmission;

flow line means for establishing a fluid path between said manifold piping and said Christmas tree;

a first remotely operable valve means, said first valve means located in said flow line means for controlling fluid flow therethrough;

remotely operable means for removably connecting each production unit to said template, said means including a production unit hydraulic connector and a production unit connector mandrel;

flow line connector means for removably connecting said manifold piping between each of said production units and each of said Christmas trees, said manifold piping operating so that said production unit and said Christmas tree may be removed and installed independently of one another by hydraulic control lines operated from the water surface, said flow line connnector means including a hollow cylindrical member having a piston driven, reciprocally slidable hollow inner sleeve coaxially positioned and slidably movable within an outer sleeve so as to complete the flow path between said manifold piping and said Christmas tree when the inner sleeve is extended, the orientation of said flow line means being horizontal to the plane of said template whereby said Christmas tree and said production unit will lie along a common plane and can be lifted from the template independently;

a first control line means for transmitting a signal for controlling fluid flow to each Christmas tree and each production unit;

control line connector means for disconnectably connecting said first control line means between each of said Christmas trees and each of said production units, said control line connecting means operating so that each of said production units and each of said Christmas trees may be removed and installed independently of one another, said control line connector means including a hollow cylindrical member having a piston driven reciprocally slidable inner sleeve coaxially positioned and slidably movable within an outer sleeve so as to complete a control circuit from the production unit to each Christmas tree, the orientation of said control line connector means being horizontal to the plane of said template whereby said control line connector means does not interfere with removal of the Christmas trees or production units when a Christmas tree or production unit is lifted from the template;

a second remotely operable valve means, said second valve means located between each of said production units and each of said Christmas trees being used for stopping the fluid flow between each of said production units and each of said Christmas trees when either is removed;

a second control line means, said second control line means extending from the surface of the body of water to said template mounted equipment;

control pods removably connected to said template and operatively connected to said first control line means in each of said production units, each of said control pods adapted to receive signals from said second control line means for controlling the operation of each of said Christmas trees, each of said production units, said control line means, and said remotely operable valve means;

means for removably connecting each of said control pods to each of said production units; and means for removably connecting said control pod to said template.

2. The subsea drilling and production system as outlined in claim 1 where said control line means are hydraulically operated.

3. The subsea drilling and production system as recited in claim 1 where said control line means are pneumatically operated.

4. The subsea drilling and production system as recited in claim 1 where said control line means are electrically operated.

5. The subsea drilling and production system as recited in claim 1 where said production unit is divided into separate sections, each section being disconnectably connected to each other section and disconnectably connected to said template where said manifold piping and said control lines of each of said sections still maintain operative connection with one another.

6. The subsea drilling and production system as recited in claim 4 where each of said sections may be installed and removed independently of one another.

7. A subsea drilling and production system having separate elements which are capable of being installed and removed independently of one another comprising:

a drilling template;

a casing head established at wells drilled through said template;

a Christmas tree removably connected to casing heads where wells are produced;

remotely operable means for removably connecting said Christmas tree to said casing head;

a production unit removably connected to said template, said production unit including manifold piping and control means, said manifold piping including piping involving production handling, annulus access, gas and fluid lift, gas and fluid injection, pressure maintenance, and said control means including electrical cables and hydraulic piping for signal and energy transmission;

remotely operable means for removably connecting said production unit to said template;

flow line means for establishing a fluid path between said manifold piping in said production unit and said Christmas tree;

a first remotely operable valve means, said first valve means located in said flow line means for controlling fluid flow therethrough;

flow line connector means for removably connecting said flow line means between said production unit and said Christmas tree, the orientation of said flow line means being horizontal to the plane of said template whereby said Christmas tree and said production unit will lie along a common plane and can be lifted from the template independently;

control line means for transmitting a signal for controlling fluid flow to said Christmas tree and said production unit;

control line connector means for removably connecting said control line means between said Christmas tree and said production unit, the orientation of said control line connector means being horizontal to the plane of said template whereby said Christmas tree and said production unit will lie along a common plane and can be lifted from the template independently;

a second remotely operable valve means for stopping the fluid flow between said production unit and said Christmas tree when either is removed;

a control pod removably connected to said template and operatively connected to said control line means in said production unit, said control pod adapted to receive signals for controlling the operation of said template mounted equipment;

means for controlling said template mounted equipment, said means being located on the surface of said body of water;

means for intercommunication between said control system on the surface of said body of water and said control pod;

means for removably connecting said control pod to said production unit; and means for removably connecting said control pod to said template.

8. The subsea drilling and production system as outlined in claim 7 where said control line means is hydraulically operated.

9. The subsea drilling and production system as outlined in claim 7 where said control line means is pneumatically operated.

10. The subsea drilling and production system as outlined in claim 7 where said control line means is electrically operated.

11. The subsea drilling and production system as recited in claim 7 where the means for intercommunication between said surface control equipment and said control pod is hydraulically operated.

12. The subsea drilling and production system as recited in claim 7 where the control means for intercommunication between said surface control equipment and said control pod is pneumatically operated.

13. The subsea drilling and production system as recited in claim 7 where the control means for intercommunication between said surface control equipment and said control pod is electronically operated.

14. A method for drilling and producing wells at a subsea site in which elements of the system are independently installable and removable, comprising:

lowering a drilling template to the bottom of a body of water, said template having a plurality of apertures formed through which wells may be drilled;

establishing a casing head at each well drilled through said template;

removably connecting a production unit for each well section to said template with a production unit hydraulic connector and a production unit connector mandrel, said production unit including manifold piping and control means, said manifold piping including piping involving production handling, annulus access, gas and fluid lift, gas and fluid injection, and pressure maintenance, said control means including electrical cables and hydraulic piping for signal and energy transmission, said production unit being arranged in discrete sections, each of said sections being able to independently service a number of wells, said sections adapted to be installed and removed independently of one another without interrupting the production from the wells of other sections;

removably connecting a Christmas tree on casing heads of wells to be produced;

removably connecting said Christmas tree to said production unit through flow line connectors and control line connectors so that said Christmas tree and said manifold piping may be removed and installed independently of one another such that once installed, said flow line connectors will establish a path for fluid flow through a flow line between said Christmas trees and said manifold piping and said control line connector will establish a path for transmission of control signals through a first control line means to control fluid flow to each production unit and to each Christmas tree, said flow line connector means including a hollow cylindrical member having a piston driven, reciprocally slidable hollow inner sleeve coaxially positioned and slidably movable within an outer sleeve so as to complete the flow path between said manifold piping and said Christmas tree when the inner sleeve is extended, the orientation of said flow line connector means being horizontal to the plane of said template whereby said Christmas tree and said production unit will lie along a common plane and can be lifted from the template independently; said control line connecting means including a hollow cylindrical member having a piston driven reciprocally slidable inner sleeve, coaxially positioned and slidably movable within an outer sleeve so as to join the first control line means of the production unit and each Christmas tree, the orientation of said control line connector being horizontal to the plane of said template whereby said control line connector means does not interfere with removal of the Christmas trees or production units when lifted from the template;

inserting a first remotely operable valve means in said flow line means for controlling fluid flow therethrough;

stopping the flow of fluid from said Christmas tree by a second remotely operable valve means when said production unit is removed from said Christmas tree;

a second control line means extending between the surface of the body of water to said template mounted equipment;

removably connecting a control pod to said template;

operatively connecting said control pod to said production unit through said first control line means and said production unit, said control pod adapted to receive signals from said second control line means extending between the surface of a body of water to the template mounted equipment for controlling the operation of said Christmas trees, production units, flow line and control line connectors, and said remotely operable valve means.

15. The method for drilling and producing wells at a subsea site as recited in claim 14 where said flow line connectors are engaged by:

flowing fluid through a first port to act on one face of a connector piston;

moving an inner sleeve towards an outer sleeve in a direction away from a first port and towards a receiver; and exhausting any fluid on the opposite side of said piston through a second port.

16. The method for subsea drilling and production as recited in claim 15 where said flow line connectors are disengaged by:

flowing fluid through said second port to act on the opposite face of a connector piston;

moving said inner sleeve away from said second port and away from said receiver; and exhausting fluid through said first port.

17. The method for drilling and producing wells as recited in claim 14 where said control lines are connected by:

flowing a fluid through a first port to exert pressure on a piston;

moving an inner sleeve forward away from said first port to engage a receiver; and exhausting any fluid on the opposite side of said piston through a second port.

18. The method for subsea drilling and production as recited in claim 17 where the control line connector is disengaged by:

flowing a fluid through a second port;

moving said inner sleeve rearward away from said second port and away from said receiver; and exhausting any fluid on the opposite side of said piston through said first port.

19. A method for drilling and producing wells from a subsea site in which elements of the system are remotely and independently installable and removable by hydraulic lines operable at the surface of the water comprising:

lowering a drilling template to the bottom of a body of water, said template having a plurality of apertures formed through which wells are drilled;

establishing a casing head at each well drilled through said template;

removably connecting an independent production unit for each well to said template independent of all other template mounted equipment, said production unit including manifold piping and control means, said manifold piping including piping involving production handling, the production itself, annulus access, gas and fluid lift, gas and fluid injection, pressure maintenance, and said control means including electrical cables and hydraulic piping for signal and energy transmission;

removably connecting a Christmas tree to each of said casing heads of wells to be produced, said Christmas tree remotely connectable and removable;

removably connecting said Christmas tree to said manifold piping of each of said production units for each well;

controlling fluid flow by using a valve means in a flow line means between each of said Christmas trees and each of said production units, said flow line means oriented horizontally to the plane of the template whereby said Christmas trees and said production units can be lifted from the template independently; and controlling the operation of said template mounted equipment from a remote point by hydraulic means.

20. A subsea drilling and production system having a template through which wells are drilled, each well having its own remotely and independently connectable and removable system of equipment that service the well, which comprises:

a template having wells drilled therethrough;

a casing head at each well;

a Christmas tree at each casing head that is removably connectable to each of said casing heads and independently removable from all other subsea equipment, said connection and disconnection being made from a remote control line operable from the surface of the sea;

manifold piping having separate sections for each well system, said manifold piping being removably connectable to said template and said manifold piping sections for each well independently removable from all other manifold piping sections, said Christmas tree, said casing head, and said template, said connection and disconnection to said template being made from a remote control line at the surface of the sea;

means for removably connecting each of said Christmas trees to said manifold piping sections in a fluid relationship so that each of said manifold piping sections and each of said Christmas trees for each independent well system may be removed or installed without removing each of said other sections of manifold piping or Christmas trees, said connecting and disconnecting means being horizontally oriented to the plane of said template and operable from a remote control line on the surface of the sea whereby said Christmas tree and said production unit will lie along a common plane and can be lifted from the template independently;

a control pod for each well system which is removably connected to said template for controlling the operation of each of said Christmas trees and each section of said manifold piping; and means for removably connecting each of said control pods to each of said Christmas trees and said template so that each of said control pods may be remotely removed and installed independent of other subsea equipment from a remote control line operable from the surface of the sea.

* * * * *